United States Patent [19]

Nakamura et al.

[11] Patent Number: 4,543,057

[45] Date of Patent: Sep. 24, 1985

[54] POT-TYPE OIL BURNER

[75] Inventors: Kazuharu Nakamura; Motoki Matsumoto; Tooru Yoshino, all of Aichi, Japan

[73] Assignee: Toyotomi Kogyo Co., Ltd., Aichi, Japan

[21] Appl. No.: 491,131

[22] Filed: May 3, 1983

[51] Int. Cl.[4] ..... F23D 11/02; F23D 11/44

[52] U.S. Cl. ..... 431/208; 431/258; 431/260; 431/333; 431/334; 431/170; 126/144

[58] Field of Search ..... 431/208, 258, 260, 333, 431/334, 335, 336, 337, 338, 340, 341, 170; 126/95, 93, 144, 59.5

[56] References Cited

U.S. PATENT DOCUMENTS

| | | | |
|---|---|---|---|
| 1,968,360 | 7/1934 | Sturgis | 431/208 |
| 2,073,552 | 3/1937 | Curioni | 431/260 |
| 2,337,734 | 12/1943 | Breese | 431/340 |
| 2,486,481 | 11/1949 | Kissam | 126/93 |
| 2,647,567 | 8/1953 | Ciglia | 431/208 |
| 3,099,258 | 7/1963 | Kurz | 126/93 |
| 3,653,794 | 4/1972 | Shakiba | 431/208 |
| 4,141,505 | 2/1979 | Reich | 431/203 |
| 4,402,664 | 9/1983 | Kutrieb | 126/93 |

FOREIGN PATENT DOCUMENTS

| | | | |
|---|---|---|---|
| 0053610 | 4/1980 | Japan | 431/208 |
| 0118507 | 9/1980 | Japan | 431/208 |
| 1304307 | 1/1973 | United Kingdom | 431/208 |

*Primary Examiner*—Samuel Scott
*Assistant Examiner*—Helen Ann Odar
*Attorney, Agent, or Firm*—Pollock, Vande Sande & Priddy

[57] ABSTRACT

A pot-type oil burner is disclosed which is capable of stabilizing the vaporization rate of fuel oil in a pot to accomplish the stable complete combustion with a good efficiency. The oil burner is constructed to arrange a heat-resistant fabric on the bottom surface of the pot to vaporize fuel oil with a constant rate. The oil burner is also capable of significantly reducing retention of tar in the pot and facilitates removing tar from the pot as desired.

14 Claims, 2 Drawing Figures

POT-TYPE OIL BURNER

BACKGROUND OF THE INVENTION

1. Field of the Invention

This invention relates to an improved pot-type oil burner, and more particularly to a pot-type oil burner which is adapted to stabilize the vaporization rate of fuel oil in a pot to form a uniform combustible gas, to thereby carry out stable and efficient combustion.

2. Description of the Prior Art

In a pot-type oil burner which does not use a wick, it has been required to keep a pot or a vaporization means at a high temperature utilizing radiant heat emitted from a combustion chamber and/or heat emitted from an electric heater in order to effectively carry out in the pot the vaporization of fuel oil such as kerosene. In the oil burner of such type, there appears a phenomenon that fuel oil supplied to the pot, when heated to a high temperature, is distributed in the form of fine particles on the walls of the pot and is vaporized over a prolonged period of time. Unfortunately, this results in a conventional oil burner of such type having a disadvantage that it is substantially impossible to stably supply vaporized fuel oil to a combustion chamber at a uniform rate, because it does not have any means effective to prevent such phenomenon. Further, it should be noted that such phenomenon appears in a pot of a relatively low temperature as well as a high temperature.

Also, the conventional pot-type oil burner has another disadvantage that the vaporization of fuel oil supplied to the pot starts with a fraction of a lower boiling temperature, thereby causing tar to remain in the pot, resulting in the oil burner causing an incomplete combustion.

BRIEF SUMMARY OF THE INVENTION

The present invention has been made in view of the foregoing disadvantages of the prior art.

Accordingly, it is an object of the present invention to provide a pot-type oil burner which is capable of stabilizing the vaporization rate of fuel oil in a pot and forming a uniform combustible gas to accomplish the stable combustion with a good efficiency.

It is another object of the present invention to provide a pot-type oil burner which is capable of significantly reducing retention of tar in a pot to carry out the stable complete combustion.

It is still a further object of the present invention to provide a pot-type oil burner which facilitates removing tar remaining in a pot as desired, to constantly ensure the stable complete combustion.

In accordance with the present invention, there is provided a pot-type oil burner comprising a pot carrying out at least the vaporization of fuel oil supplied thereto; an air supply means for supplying air to the pot; an oil supply means for supplying fuel oil to the pot; an air pipe for introducing a part of air flowing through the air supply means therethrough to the pot; an oil pipe for introducing fuel oil from the oil supply means therethrough to the pot; a fabric formed of a heat-resistant fiber and spread on the bottom surface of the pot; a heating means for heating the pot and fabric to a temperature sufficient to vaporize fuel oil supplied to the pot; and a nozzle means connected with the oil pipe to eject fuel oil therefrom into the pot and positioned with respect to the air pipe so as to supply the ejected fuel oil in the form of fine particles toward the substantially entire surface of the fabric by means of air supplied from the air pipe into the pot.

The fabric may be spread over the substantially entire bottom surface of the pot. A preferred embodiment of the present invention may be constructed in a manner such that the air pipe and oil pipe merge into a single pipe extending to the pot to carry fuel oil on air, the nozzle means is provided at the end of the single pipe, the heating means is arranged adjacent to the fabric in the pot, and the pot is provided at the side wall thereof with a plurality of through-holes communicated with the air supply means, whereby the pot carries out the mixing of vaporized fuel oil with air supplied through the through-holes thereto and the ignition as well as the vaporization. Alternatively, the oil burner may be constructed to extend the oil pipe through the interior of the air pipe into the pot and mount the heating means on the outside of the bottom wall of the pot. Also, the fabric may be formed into a reticulate shape to carry an oxidation catalyst thereon. Furthermore, the present invention may be constructed to removably arrange the fabric in the pot.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate the same parts throughout the figures thereof and wherein.

DETAILED DESCRIPTION OF THE PREFERRED EMBODIMENTS

Now, a pot-type oil burner according to the present invention will be described hereinafter with reference to the accompanying drawings.

Figure 1:
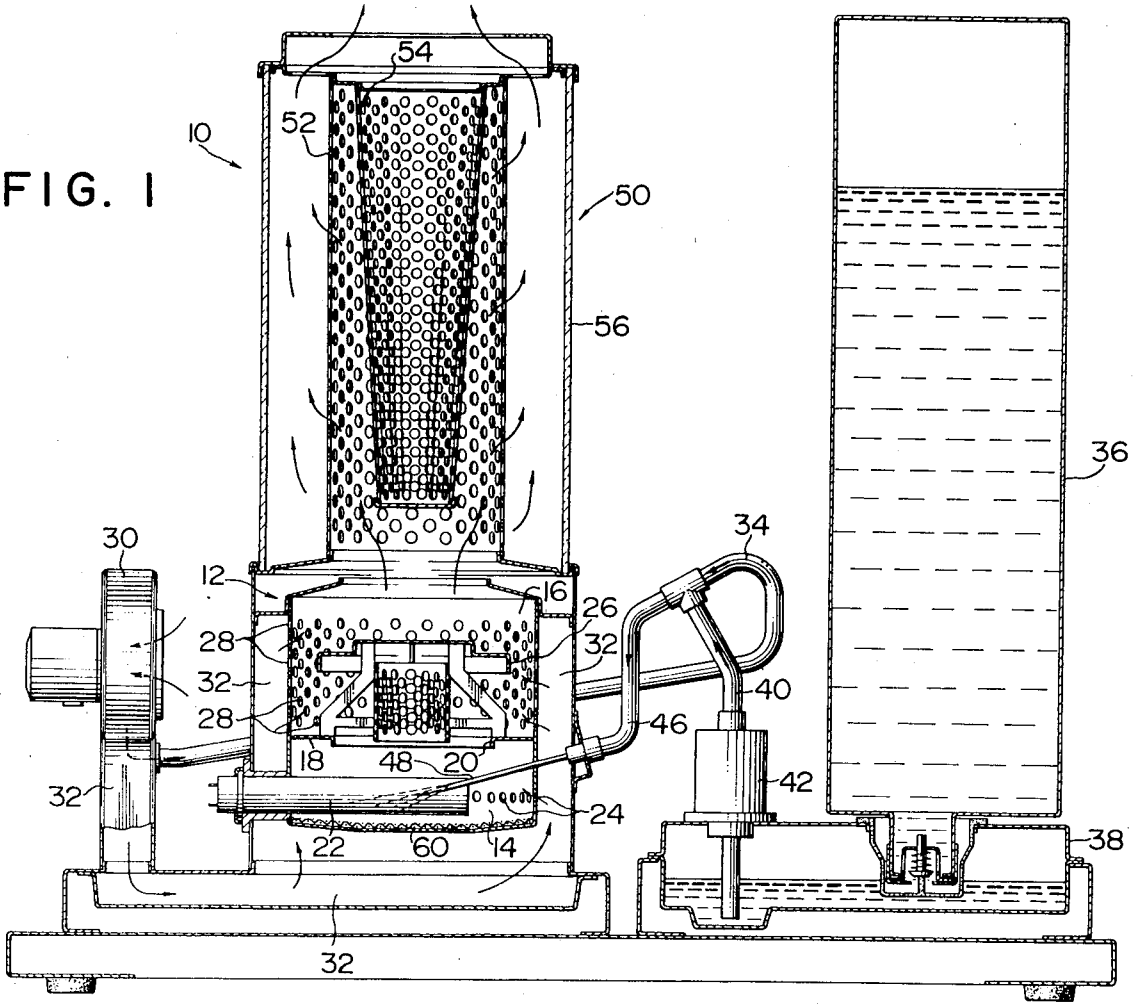
FIG. 1 is a vertical sectional view showing one embodiment of a pot-type oil burner according to the present invention.

FIG. 1 illustrates one embodiment of a pot-type oil burner according to the present invention wherein the oil burner is generally designated by reference numeral 10. The pot-type oil burner illustrated in FIG. 1 is a red-hot type oil space heater, however, it should be noted that the oil burner is not limited to such space heater.

The oil burner 10 includes a pot 12 which is adapted to carry out therein the vaporization, mixing and ignition of fuel oil such as kerosene supplied thereto. The pot 12 is separated into a lower chamber 14 and an upper chamber 16 by a horizontal partition 18 having an opening 20 formed at the central portion thereof, through which the lower and upper chambers 14 and 16 are communicated with each other. The lower chamber 14 has an electric heater 22 provided therein which serves to heat fuel oil to vaporize it and also serves to ignite the vaporized fuel oil to burn a part thereof using air supplied from through-holes 24 formed at the side wall thereof. The upper chamber 16 has a mixing means 26 provided therein, which is arranged at a position above the opening 20. The mixing means 26 acts to form a combustible gas in the upper chamber 16 by uniformly diffusing in the upper chamber 16 fuel oil vaporized in the lower chamber 14 and allowing the diffused oil fuel to be mixed with air supplied to the chamber 16 through a plurality of through-holes 28 formed at the side wall of the chamber 16.

The oil burner 10 also includes an air supply means for supplying air to the pot 12. The air supply means comprises an air fan 30 provided at the outside of the burner and an air supply passage 32 defined in the burner 10 and connected to the fan 30. The air passage 32 is communicated with the interior of the pot 12 through the through-holes 24 and 28 of the pot and an air supply pipe 34 connected between the passage 32 and the pot 12.

Furthermore, the oil burner 10 includes an oil supply means for supplying fuel oil to the pot 12, which comprises an oil tank 36 and an oil reservoir 38. The oil reservoir 38 is adapted to support the oil tank 36 in an inverted manner and also keeps the level of fuel oil therein substantially constant. The oil reservoir 38 is communicated with the pot 12 through an oil supply pipe 40 so that fuel oil may be supplied from the tank 36 therethrough to the pot 12. In the embodiment illustrated, fuel oil is supplied by means of an electromagnetic pump 42 connected between the oil supply pipe 40 and the reservoir 38.

The pot-type oil burner of the embodiment, as shown in FIG. 1, is also constructed in a manner such that the air supply pipe 34 and the oil supply pipe 40 merge into a single pipe 46 extending to the pot 12 so that fuel oil carried on air may be supplied to the pot and the oil supply pipe 40 or single pipe 46 is formed at the end portion thereof extending through the side wall of the pot 12 therein with a nozzle pipe 48. This allows a fuel oil mixed with air and carried thereon to be ejected in the form of fine particles therefrom into the pot.

Above the pot 12, a combustion chamber 50 is arranged which is adapted to burn therein a combustible gas formed in the upper chamber 16 of the pot utilizing combustion air supplied from the air passage 32 through the through-holes 28 thereto and heat of fuel oil burned in the pot 12. The combustion chamber 50 has an outer perforated combustion cylinder 52 and an inner perforated combustion cylinder 54 each formed of a ceramic material. A combustible gas formed in the pot 12 and supplied to the combustion chamber 50 is burned on the outer surface of the inner cylinder 54 and the both surfaces of the outer cylinder 52 to red-heat the cylinders 52 and 54, to thereby allow the cylinders to emit heat rays. Around the outer combustion cylinder 52 is disposed a transparent heatpermeable cylinder 56 formed of a heat-resistant glass through which heat rays emitted from the cylinders are discharged to the exterior of the burner. A combustion gas produced in the combustion chamber 50 is discharged through an opening provided at the top surface of the combustion chamber to the exterior of the burner. Alternatively, an auxiliary combustion chamber may be arranged above the chamber 50 in communication therewith to completely burn a combustible gas and/or an incomplete combustion gas which may remain in a combustion gas produced in the combustion chamber 50.

One of the essential features of the present invention is that a fabric 60 formed of a heat-resistant fiber such as silica fiber, an asbestos fiber or the like is put down on the bottom surface of the lower chamber 14 of the pot 12 and heated to a high temperature by a heater 22. The fabric 60 is preferably a woven fabric although it may be a non-woven fabric. The fabric 60 is preferably spread on the substantially entire bottom surface of the pot. In the embodiment shown in FIG. 1, the fabric 60 is disposed immediately below the heater 22 so as to be readily heated to a high temperature. This effectively prevents a part of the fuel oil supplied to the pot and heated to a high temperature from being distributed in the form of fine particles in the pot, particularly, on the bottom surface thereof. Also, such construction has another advantage that the fabric absorbs fuel oil to allow the fuel oil to have an enlarged surface area, so that the fuel oil may be instantly vaporized. Thus, it is possible to stably supply vaporized fuel oil to the combustion chamber at a uniform rate, because the fuel oil can be continuously and constantly vaporized in the pot. Further, it is possible to significantly reduce the deposition of tar in the pot because fuel oil heated to a high temperature is prevented from being distributed within the pot.

It is preferable that the fabric 60 is merely put down on the bottom surface of the pot in order that when tar is substantially deposited on the fabric, it may be readily removed from the pot for the purpose of exchange. Also, the fabric is preferably formed in a reticulate shape to allow an oxidation catalyst such as platinum or the like to be carried thereon. This results in materials hard to be vaporized being readily vaporized.

Another feature of the present invention is that fuel oil is supplied in the form of fine particles to the pot. Fuel oil is preferably sprayed on the substantially entire surface of the fabric. The embodiment shown in FIG. 1 is constructed in a manner such that the tip of nozzle pipe 48 is disposed adjacent to the fabric 60 and the pipe gently slopes downwardly toward the fabric, to thereby allow a drizzle-like fuel oil ejected from the nozzle to be sprayed on the entire fabric.

Now, the manner of operation of the pot-type oil burner illustrated in FIG. 1 will be explained hereinafter.

Electric current is supplied to the heater 20, the air fan 30 and the electromagnetic pump 42 to heat the pot 12 and the fabric 60 to a predetermined temperature, supply air to the air supply passage 32, and initiate the supply of fuel oil to the oil supply pipe 40, respectively. Fuel oil is supplied from the reservoir 38 through the oil supply pipe 40 to the nozzle pipe 48 of the single pipe 46 and concurrently air is supplied from the air supply passage 32 through the air supply pipe 34 to the nozzle pipe 48, so that the fuel oil is carried on the air in the nozzle pipe 48 and ejected in the form of fine particles from the nozzle pipe into the lower chamber 14 of the pot 12 at a relatively high velocity. The fuel oil ejected into the lower chamber 14 is dispersed toward the entire surface of the fabric 60 heated to a high temperature to be stably vaporized at a uniform rate. In the embodiment of FIG. 1, the heater 22 also serves to ignite the vaporized fuel oil to allow a part thereof to be burned in the pot 12 using air mainly supplied through the through-holes 24 to the lower chamber 14. The vaporized fuel oil is then introduced through the central opening 20 of the horizontal partition wall 18 into the upper chamber 16 and mixed with air supplied from the passage 32 through the through-holes 28 of the chamber 16 thereto to form a combustible gas. The so-formed combustible gas is supplied to the combustion chamber 50 together with the fuel oil ignited in the lower chamber 14 to be subjected to combustion in the chamber 50 using combustion air supplied from the passage 32 through the holes 28 of the upper chamber 16 to the chamber 50. The combustion allows the cylinders 52 and 54 to be red-heated to emit heat rays which are discharged through the heat-permeable cylinder 51 to the exterior. A hot combustion gas produced by the combustion chamber 50 is discharged through an upper opening of the combustion chamber to the exterior.

Figure 2:
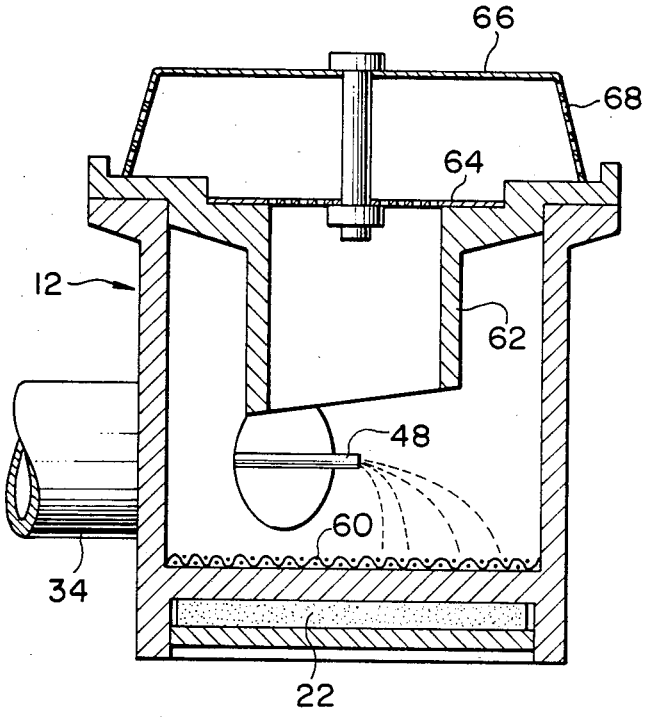
FIG. 2 is a vertical sectional view showing an essential part of another embodiment of a pot-type oil burner according to the present invention.

FIG. 2 shows another embodiment of a pot-type oil burner according to the present invention. The oil burner of the present embodiment is the type for carrying out heating mainly due to convection. More particularly, the oil burner 10 includes a pot 12 which has a fabric 60 formed of a heat-resistant fiber and spread on the entire bottom surface thereof. The pot 12 has an electric heater 22 mounted on the outside of the bottom wall thereof to heat the pot 12 and the fabric 60 to a high temperature sufficient to vaporize a fuel oil supplied thereto. The pot also has an air supply pipe 34 for supplying air from an air supply means (not shown) therethrough to the pot and a nozzle pipe 48 extending through the interior of the air supply pipe 34 into the pot 12. The nozzle pipe 48 acts to supply fuel oil from an oil supply means (not shown) therethrough to the pot 12. Thus, fuel oil ejected from the nozzle pipe 48 is formed into fine particles by air supplied from the pipe 34 to the pot 12, carried on the air and sprayed on the entire surface of the fabric 60 heated to a high temperature; so that the fuel oil may be vaporized. The vaporized fuel oil is then supplied to a mixing tube 62 vertically arranged at the upper portion of the pot 12 together with air introduced from the pipe 34 to the pot, wherein the fuel oil is substantially mixed with the air to form a combustible gas. The so-formed combustible gas is guided through a perforated plate 64 to a combustion means or combustion plate 66 having a plurality of through-holes 68 formed at the side wall thereof and is ignited by a suitable igniting means. The ignited combustible gas is burned at the combustion plate 66 to form a blue flame via the through-holes 68, to thereby produce a combustion heat of a high temperature. The heat is carried on a combustion gas and discharged through an exhaust port (not shown) of the oil burner. Thus, it will be readily understood that the present embodiment has the same advantages as that of FIG. 1.

As can be seen from the foregoing, the present invention is capable of continuously and constantly vaporizing fuel oil to stably supply it to the combustion chamber at a uniform rate. Furthermore, the present invention is capable of significantly reducing retention of tar in the pot and facilitates removal, as desired of, tar remaining in the pot, to thereby constantly ensure complete combustion.

As many apparently widely different embodiments of this invention may be made without departing from the spirit and scope thereof, it is to be understood that the invention is not limited to the specific embodiment thereof except as defined in the appended claims.

What is claimed is:

1. A pot-type oil burner comprising:

a pot for carrying out therein not only the vaporization and mixing, but also the ignition and combustion of fuel oil supplied thereto;

air supply means for supplying air to said pot;

oil supply means for supplying fuel oil to said pot;

an air pipe for introducing at least a part of the air flowing through said air supply means therethrough to said pot;

an oil pipe for introducing fuel oil from said oil supply means therethrough to said pot;

a fabric formed of a heat-resistant, oil absorbent fiber and spread on the bottom surface of said pot;

heating means arranged in said pot immediately above said fabric for heating the interior of said pot and said fabric to a temperature sufficient not only to vaporize and mix, but also to ignite and combust therein, fuel oil supplied to said pot, said heating means being positioned sufficiently close to said fabric to cause ignition and burning of fuel oil vaporized by said fabric; and a nozzle means connected with said oil pipe for ejecting fuel oil into said pot, said nozzle means being positioned with respect to said air pipe so that said fuel oil is dispersed in the form of fine particles toward substantially the entire surface of said fabric by means of air supplied from said air pipe into said pot, whereby fuel dispersed toward said surface of said fabric is stably vaporized at a uniform rate and is ignited by said heating means.

2. A pot-type oil burner as defined in claim 1 wherein said fabric is spread over substantially the entire bottom surface of said pot.

3. A pot-type oil burner as defined in claim 2, wherein said air pipe and said oil pipe merge into a single pipe extending to said pot, said nozzle means is provided at the end of said single pipe, and said pot is provided at the side wall thereof with through-holes communicating with said air supply means, whereby said pot carries out the mixing of vaporized fuel oil with air supplied through said through-holes thereto.

4. A pot-type oil burner as defined in claim 2, wherein said oil pipe is arranged to extend through the interior of said air pipe into said pot.

5. A pot-type oil burner as defined in claims, 1, 2, 3 or 4, wherein said fabric is removeably arranged in said pot.

6. A pot-type oil burner as defined in claim, 1, 2, 3 or 4, wherein said fabric is formed into a reticulate shape and has an oxidation catalyst carried thereon.

7. A pot-type oil burner as defined in claim 6, wherein said fabric is removeably arranged in said pot.

8. A pot-type oil burner comprising:

a pot having a plurality of through-holes formed at the side wall thereof to carry out not only vaporizing and mixing but also igniting and combustion of fuel oil supplied thereto;

air supply means for supplying air to said pot;

oil supply means for supply fuel oil to said pot;

an air pipe for introducing a part of the air flowing through said air supply means therethrough to said pot;

an oil pipe for introducing fuel oil from said oil supply means therethrough to said pot;

a single pipe into which said air pipe and said oil pipe merge;

a fabric formed of a heat-resistant, oil absorbent fiber and spread on substantially the entire bottom surface of said pot;

a heating means arranged in said pot immediately above said fabric to heat the interior of said pot and said fabric to a temperature sufficient not only to vaporize and mix, but also to ignite and combust therein, fuel oil supplied to said pot, said heating means being positioned sufficient close to said fabric to cause ignition and burning of fuel oil vaporized by said fabric; and nozzle means provided at the end portion of said single pipe and positioned above said fabric to eject fuel oil carried on air therefrom toward substantially the entire surface of said fabric by means of air supplied from said air pipe into said pot.

9. A pot-type oil burner comprising:

a pot for carrying out therein not only the vaporization and mixing, but also the ignition and combustion of fuel oil supplied thereto;

air supply means for supplying air to said pot;

oil supply means for supplying fuel oil to said pot;

an air pipe for introducing at least a part of the air flowing through said air supply means therethrough to said pot;

an oil pipe for introducing fuel oil from said oil supply means therethrough to said pot;

a fabric formed of a heat-resistant, oil absorbent fiber and spread on the bottom surface of said pot, said fabric having an oxidation catalyst carried thereon;

heating means arranged in said pot immediate above said fabric for heating the interior of said pot and said fabric to a temperature sufficient not only to vaporize and mix, but also to ignite and combust therein, fuel oil supplied to said pot, said heating means being positioned sufficiently close to said fabric to cause ignition and burning of fuel oil vaporized by said fabric; and a nozzle means connected with said oil pipe for ejecting fuel oil into said pot, said nozzle means being positioned with respect to said air pipe so that said fuel oil is dispersed in the form of fine particles toward substantially the entire surface of said fabric by means of air supplied from said air pipe into said pot, whereby fuel dispersed toward said surface of said fabric is stably vaporized at a uniform rate and is ignited by said heating means.

10. A pot-type oil burner as defined in claim 9 wherein said fabric is spread over substantially the entire bottom surface of said pot.

11. A pot-type oil burner as defined in claim 9 wherein said air pipe and said oil pipe merge into a single pipe extending to said pot, said nozzle means is provided at the end of said single pipe, and said pot is provided at the side wall thereof with through-holes communicating with said air supply means, whereby said pot carries out the mixing of vaporized fuel oil with air supplied through said through-holes thereto.

12. A pot-type oil burner as defined in claim 9 wherein said oil pipe is arranged to extend through the interior of said air pipe into said pot.

13. A pot-type oil burner as defined in claim 9 wherein said fabric is removably arranged in said pot.

14. A pot-type oil burner as defined in claim 9 wherein said fabric has a reticulate shape.

* * * * *